US008899446B2

(12) United States Patent
Turner

(10) Patent No.: US 8,899,446 B2
(45) Date of Patent: Dec. 2, 2014

(54) APPARATUS FOR MIXING AND DISPENSING MULTIPLE FLOWABLE COMPONENTS

(75) Inventor: Douglas C. Turner, Abbotsford (CA)

(73) Assignee: Integra Adhesives Inc., Abbotsford, CA (US)

( * ) Notice: Subject to any disclaimer, the term of this patent is extended or adjusted under 35 U.S.C. 154(b) by 74 days.

(21) Appl. No.: 13/643,033

(22) PCT Filed: Apr. 21, 2011

(86) PCT No.: PCT/CA2011/000480

§ 371 (c)(1),
(2), (4) Date: Nov. 16, 2012

(87) PCT Pub. No.: WO2011/134059

PCT Pub. Date: Nov. 3, 2011

(65) Prior Publication Data

US 2013/0126557 A1 May 23, 2013

Related U.S. Application Data

(60) Provisional application No. 61/328,742, filed on Apr. 28, 2010.

(51) Int. Cl.

| | |
|---|---|
| ***B67D 7/70*** | (2010.01) |
| ***B05C 17/005*** | (2006.01) |
| ***B01F 5/06*** | (2006.01) |
| ***B01F 15/04*** | (2006.01) |

(52) U.S. Cl.

CPC ..... *B01F 15/0462* (2013.01); *B05C 17/00509* (2013.01); *B01F 2215/0039* (2013.01); *B01F 5/0615* (2013.01); *B01F 2005/0637* (2013.01); *B05C 17/00553* (2013.01)

USPC ..... 222/137; 222/145.5; 222/145.6; 222/326

(58) Field of Classification Search

CPC .. B29B 7/7663; B29B 7/7678; B67D 1/0044; B05B 7/0408; B05C 17/00553; B05C 17/00516; A61C 5/064

USPC ..... 222/129, 137, 145.5–145.6, 135, 222/326–327

See application file for complete search history.

(56) References Cited

U.S. PATENT DOCUMENTS

| | | | |
|---|---|---|---|
| 3,923,288 | A | 12/1975 | King |
| 4,093,188 | A | 6/1978 | Horner |

(Continued)

FOREIGN PATENT DOCUMENTS

| | | | |
|---|---|---|---|
| DE | 202009007919 | U1 | 10/2009 |
| EP | 1676791 | A1 | 7/2006 |

(Continued)

*Primary Examiner* — Frederick C Nicolas

(74) *Attorney, Agent, or Firm* — Oyen Wiggs Green & Mutala LLP

(57) ABSTRACT

An injector for co-axial-type dispensers for multiple flowable components is provided. The dispenser has a multi-chamber cartridge with a first outlet for a first flowable component arranged within a second outlet for a second flowable component. The injector includes an inner sleeve for fitting engagement with an inner wall of the first outlet of the dispenser, wherein an interior of the inner sleeve defines a first passage for the first flowable component; and an outer sleeve for fitting engagement with an outer wall of the first outlet of the dispenser.

20 Claims, 9 Drawing Sheets

(56) References Cited

U.S. PATENT DOCUMENTS

| | | | | | |
|---|---|---|---|---|---|
| 4,191,480 | A | | 3/1980 | Hiorth | |
| 4,432,469 | A | * | 2/1984 | Eble et al. | 222/134 |
| 4,767,026 | A | | 8/1988 | Keller | |
| 5,080,262 | A | * | 1/1992 | Herold et al. | 222/135 |
| 5,174,653 | A | | 12/1992 | Halat | |
| 5,228,599 | A | * | 7/1993 | Keller | 222/137 |
| 5,413,253 | A | | 5/1995 | Simmen | |
| 5,429,277 | A | * | 7/1995 | Kopp et al. | 222/145.6 |
| 5,443,183 | A | * | 8/1995 | Jacobsen et al. | 222/145.6 |
| 5,487,606 | A | | 1/1996 | Keller | |
| 5,498,078 | A | | 3/1996 | Keller | |
| 5,545,460 | A | | 8/1996 | Tanaka | |
| 5,851,067 | A | | 12/1998 | Fleischli | |
| 6,129,244 | A | | 10/2000 | Horth | |
| 6,135,631 | A | | 10/2000 | Keller | |
| 6,161,730 | A | | 12/2000 | Heusser | |
| 6,328,182 | B1 | * | 12/2001 | Brugner | 222/145.6 |
| 6,599,008 | B2 | | 7/2003 | Heusser | |
| 6,773,156 | B2 | | 8/2004 | Henning | |
| 6,874,661 | B2 | | 4/2005 | Timmerman | |
| 7,237,693 | B2 | | 7/2007 | Brennan | |
| 7,306,126 | B2 | | 12/2007 | Brugner | |
| 7,306,130 | B2 | | 12/2007 | Brugner | |
| 7,431,179 | B2 | | 10/2008 | Ritter | |
| 2008/0029542 | A1 | | 2/2008 | Keller | |
| 2011/0026359 | A1 | | 2/2011 | Ritter | |

FOREIGN PATENT DOCUMENTS

| | | | |
|---|---|---|---|
| EP | 2221114 | A1 | 8/2010 |
| EP | 2258466 | A1 | 12/2010 |
| EP | 2258468 | A1 | 12/2010 |
| JP | 2006188286 | A | 7/2006 |
| WO | 2005/095225 | A1 | 10/2005 |

* cited by examiner

APPARATUS FOR MIXING AND DISPENSING MULTIPLE FLOWABLE COMPONENTS

TECHNICAL FIELD

This invention relates to apparatus for mixing and dispensing multiple flowable components such as dual component adhesives.

BACKGROUND

Dual component adhesives are commonly dispensed from multi-chamber cartridges. Typically, one component is the adhesive in an unactivated form and the other component includes an activator (e.g. a catalyst) that activates curing of the adhesive. A static mixer coupled to an outlet of the cartridge mixes the components to activate curing of the adhesive as it is dispensed.

The two main types of cartridges are side-by-side and coaxial cartridges. Side-by-side cartridges have two storage cylinders adjacent each other in a parallel orientation. Coaxial cartridges have one storage cylinder located within another storage cylinder. Outlets for both types of cartridges may be configured in a side-by-side or coaxial manner. The present invention is directed to both side-by-side and coaxial cartridges with coaxial outlets, with one outlet located within the other outlet.

Coaxial outlets are typically circular in design which allows for use of many standard static mixers. The circular design makes the cartridge and static mixer easier to assemble because rotational orientation is not required. The design and assembly of closure plugs is also simpler because the parts are circular in shape and they do not require rotational orientation.

SUMMARY

The following embodiments and aspects thereof are described and illustrated in conjunction with systems and methods which are meant to be exemplary and illustrative, not limiting in scope. In various embodiments, one or more of the above-described problems have been reduced or eliminated, while other embodiments are directed to other improvements.

One aspect provides an injector for a dispenser for multiple flowable components, the dispenser having a multi-chamber cartridge with a first outlet for a first flowable component arranged within a second outlet for a second flowable component. The injector includes an inner sleeve for fitting engagement with an inner wall of the first outlet of the dispenser, wherein an interior of the inner sleeve defines a first passage for the first flowable component; and an outer sleeve for fitting engagement with an outer wall of the first outlet of the dispenser. The outer sleeve and the inner sleeve are coupled. The inner sleeve and outer sleeve may be concentric and may be coupled at a distal shoulder of the injector. The distal end of the first passage may have a plurality of injector outlet holes. The injector outlet holes may be oriented radially outward. The injector outlet holes may be sized to restrict backflow. The injector outlet holes may have a diameter in the range of 0.005" to 0.100", or in the range of 0.010" to 0.035". The distal end of the first passage may be hemispherical. The injector may also have an inverted frustoconical element disposed distal of the injector outlet holes and proximal of a static mixer of the dispenser. The frustoconical element may be molded integrally with the injector, molded integrally with the static mixer, or provided as a separate piece from the injector and the static mixer. The proximal portion of the distal shoulder of the injector may be configured for mating engagement with a distal tip of the first outlet. An exterior of the outer sleeve partially may define a second passage for the second flowable component. The wall thicknesses of the inner sleeve and/or the outer sleeve may be sized to provide simultaneous flow of the first flowable component and the second flowable component through the first passage and the second passage respectively into a mixing chamber of the dispenser at a predetermined mixing ratio. The outer sleeve may include a plurality of radially arranged ridges, wherein spaces between the ridges partially define the second passage. An outer wall of the ridges may include a locking element for interlocking with a locking element on an inner wall of a mixer housing of the dispenser. A proximal end of the outer sleeve may include an outwardly radiating flange for abutment against an inner wall of the second outlet. The flange may include a plurality of cutouts. The inner sleeve may displace a sufficient volume of air within the first outlet to prevent overflow of the first flowable component from the first outlet when an extended-length storage plug is inserted into the first outlet. The injector may be for a handheld cartridge dispenser or a bulk material dispensing or meter-mix dispense (MMD) system.

Another aspect provides an injector for a dispenser for multiple flowable components, the dispenser having a multi-chamber cartridge with a first outlet for a first flowable component arranged within a second outlet for second flowable component. The injector includes an inner sleeve for fitting engagement with an inner wall of the first outlet of the dispenser, wherein an interior of the inner sleeve defines a first passage for a first flowable component. The distal end of the first passage may have a plurality of injector outlet holes. The injector outlet holes may be oriented radially outward. The injector outlet holes may be sized to restrict backflow. The injector outlet holes may have a diameter in the range of 0.005" to 0.100", or in the range of 0.010" to 0.035". The distal end of the first passage may be hemispherical. The injector may also have an inverted frustoconical element disposed distal of the injector outlet holes and proximal of a static mixer of the dispenser. The frustoconical element may be molded integrally with the injector, molded integrally with the static mixer, or provided as a separate piece from the injector and the static mixer. A distal portion of the injector may include a stop for engagement with a distal tip of the first outlet. A wall thickness of the inner sleeve may be sized to provide simultaneous flow of the first flowable component and the second flowable component into a mixing chamber of the dispenser at a predetermined mixing ratio. The inner sleeve may displace a sufficient volume of air within the first outlet to prevent overflow of the first flowable component from the first outlet when an extended-length storage plug is inserted into the first outlet. The injector may be for a handheld cartridge dispenser or a bulk material dispensing or meter-mix dispense (MMD) system.

Another aspect provides a mixing assembly including: a static mixer; and an injector as described above.

Another aspect provides a mixing assembly including: a static mixer; and an injector as described above wherein the static mixer and the injector are integrally formed.

Another aspect provides a dispenser including: a multi-chamber cartridge comprising a plurality of outlets; a static mixer; and an injector as described above. At least a portion of the injector and the plurality of outlets of the multi-chamber cartridge may be integrally formed.

BRIEF DESCRIPTION OF DRAWINGS

In drawings which show non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The term "adhesive" as used in this specification includes adhesives, glues, sealants, caulks, reaction cured resins, and the like. The term "dispenser" as used in this specification includes handheld cartridge dispensers as well as bulk material dispensing or meter-mix dispense (MMD) systems such as drum or pail pump dispensers. The term "cartridge" as used in this specification includes handheld cartridges as well as cans, drums, pails, tote-bins, tanks and the like. The terms "proximal" and "distal" as used in this specification refer to positions relatively closer to and further from, respectively, the cartridge end of the dispenser. The terms "inner" and "outer" as used in this specification refer to positions relatively closer to and further from, respectively, the longitudinal axis of the cartridge outlet. The terms "inward"/"inwardly" and "outward"/"outwardly" as used in this specification refer to orientations toward and away, respectively, from the longitudinal axis of the cartridge outlet.

Figure 1:
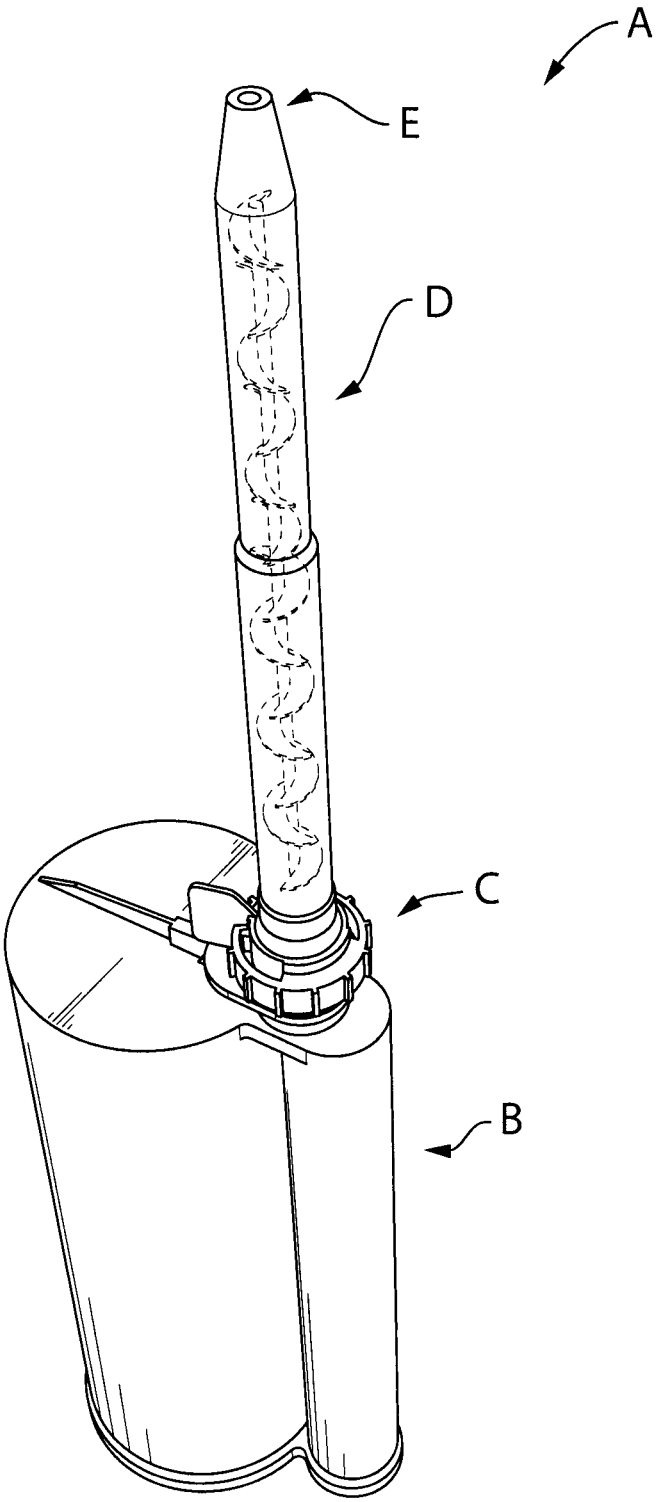
FIG. 1 is a perspective, transparent view of a prior art dispenser.
Figure 2:
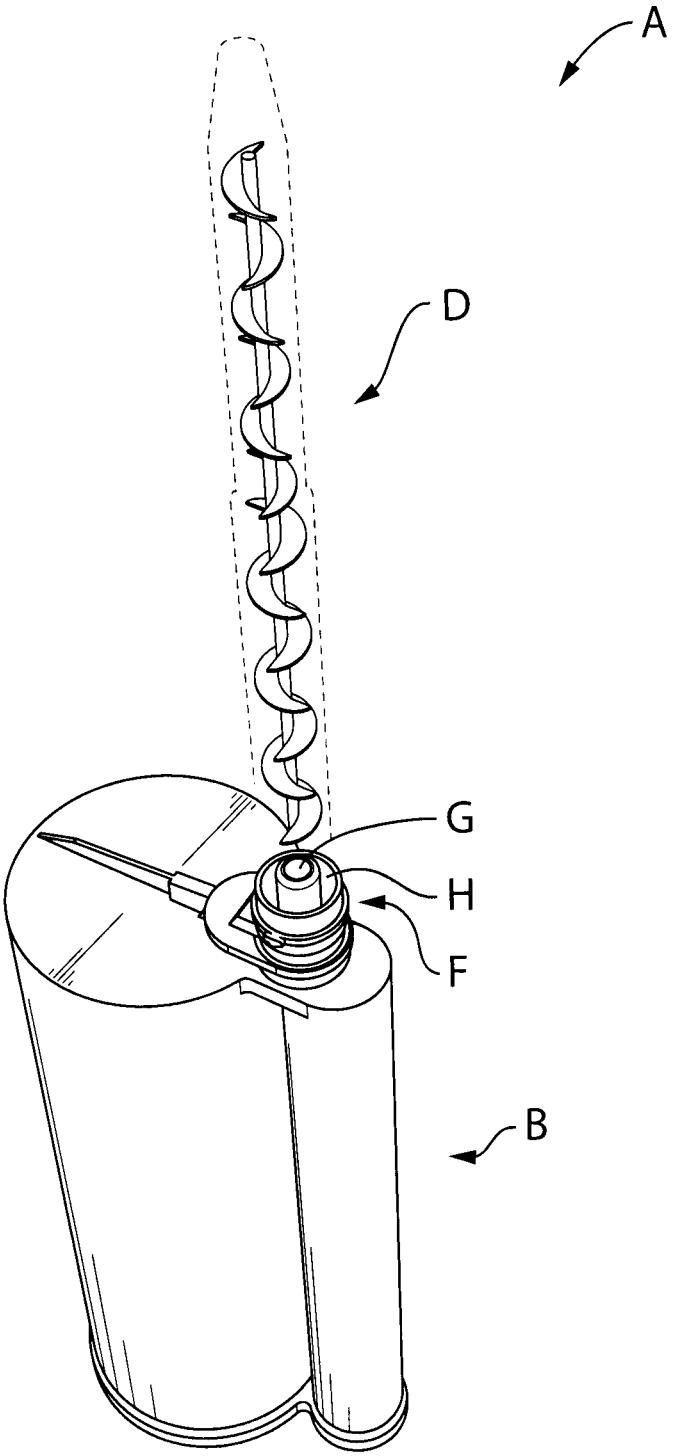
FIG. 2 is a perspective, partial cutaway view of the prior art dispenser shown in FIG. 1 with the mixer housing removed.
Figure 3:
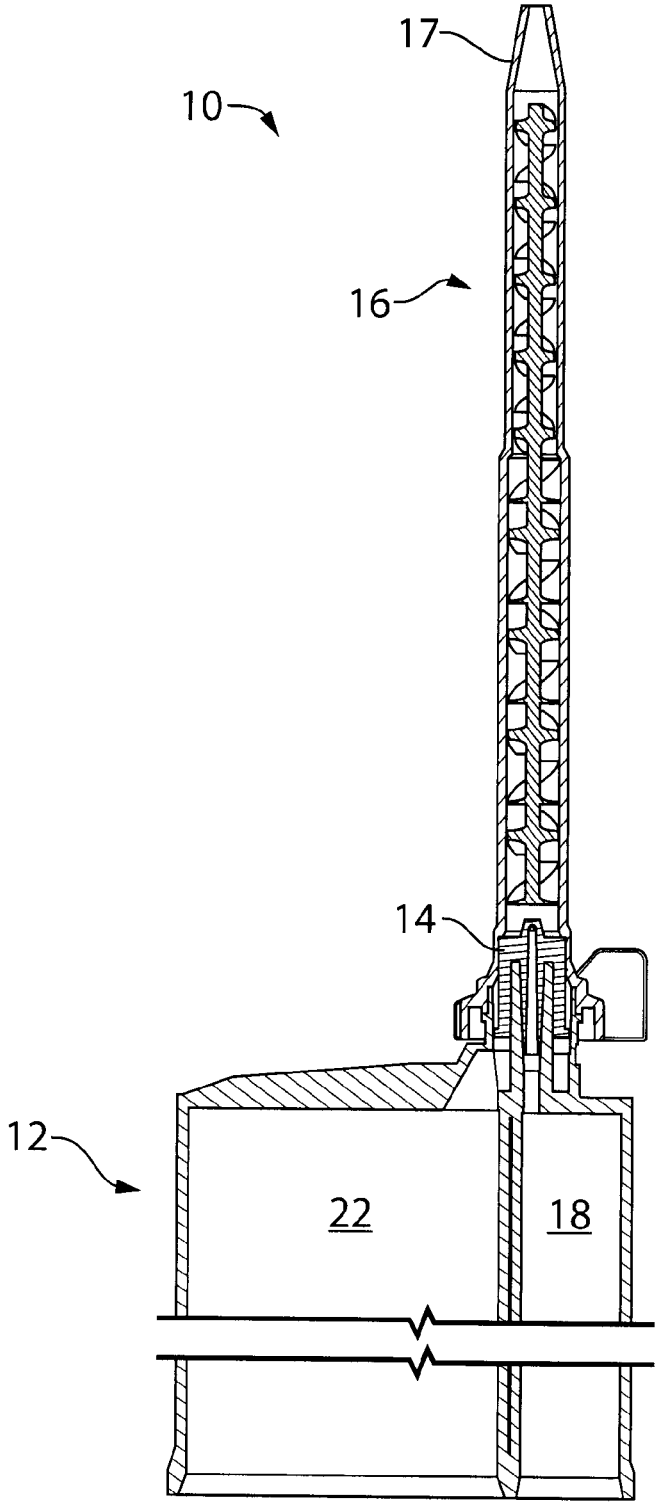
FIG. 3 is a cutaway view of a dispenser according to one embodiment of the invention.
Figure 4:
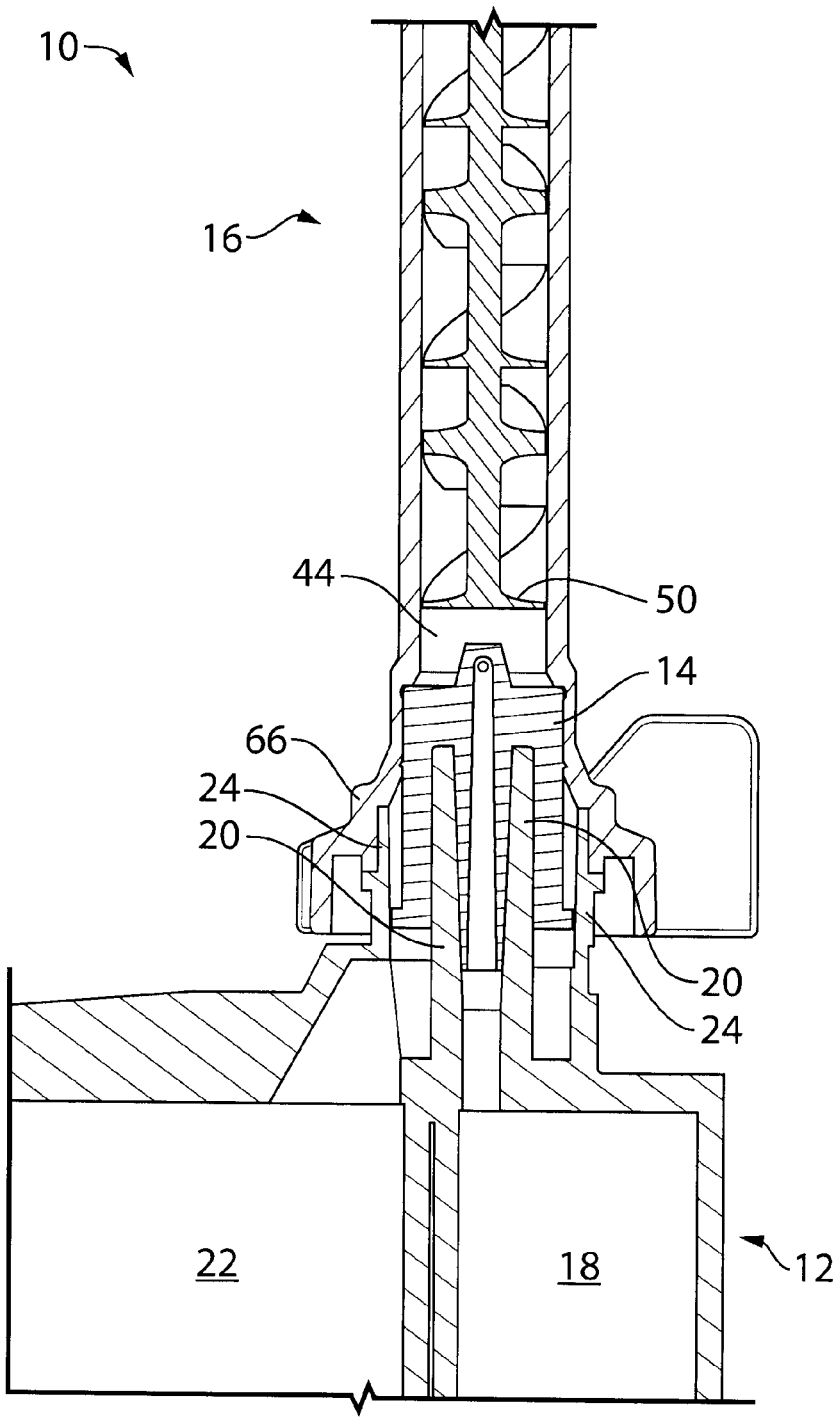
FIG. 4 is an enlarged cutaway view of a part of the dispenser shown in FIG. 3.
Figure 5:
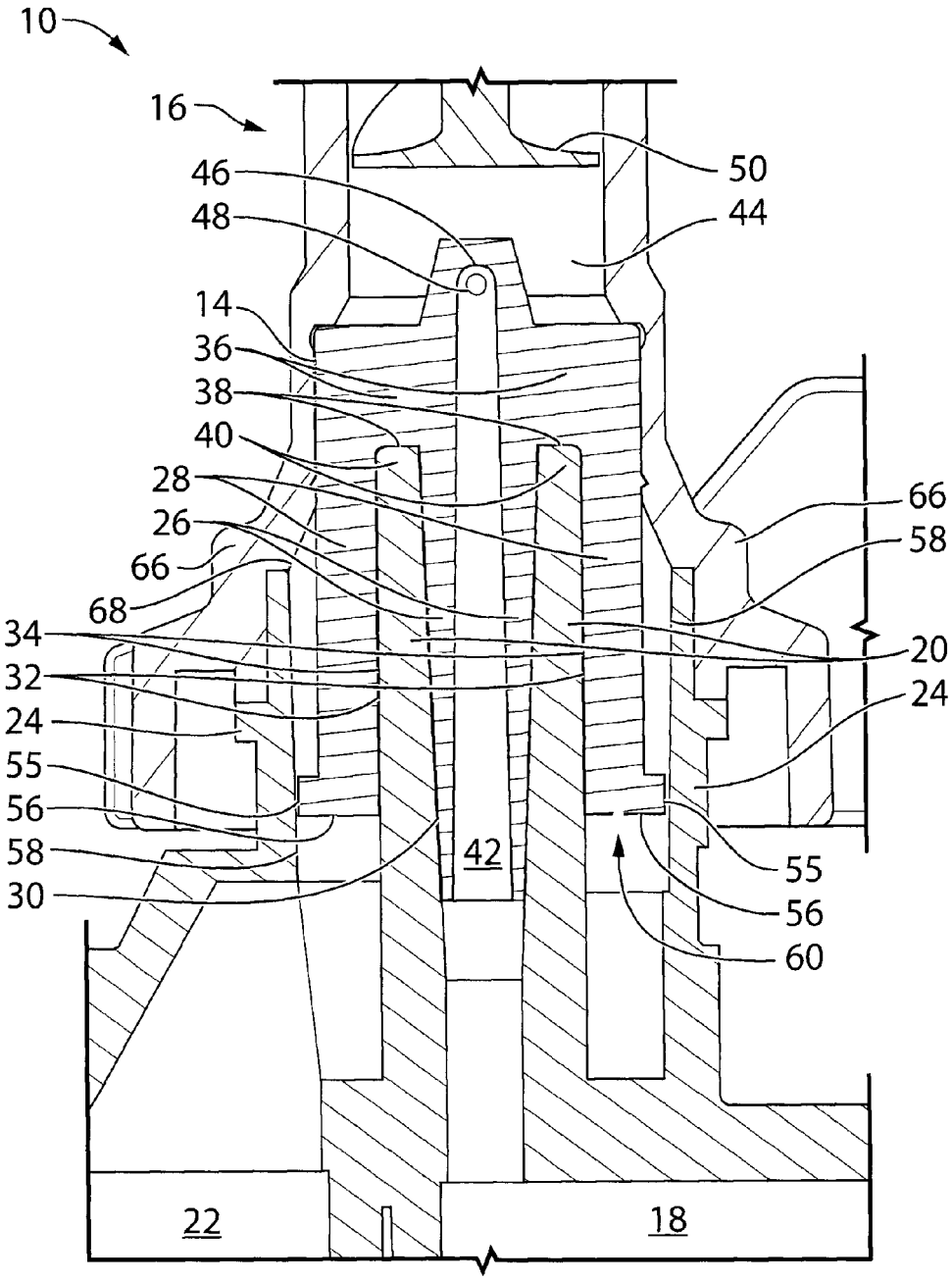
FIGS. 5 is a further enlarged cutaway view of a part of the dispenser shown in FIG. 3.
Figure 6A:
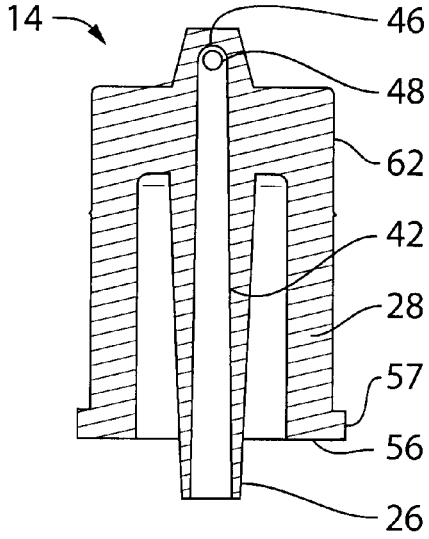
FIGS. 6A and 6C are cutaway side views of the injector of the dispenser shown in FIG. 3 in isolation.
Figure 6B:
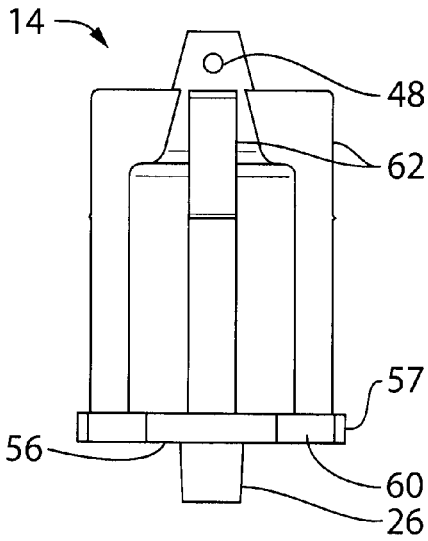
FIGS. 6B and 6D are corresponding intact side views of the injector of the dispenser shown in FIG. 3 in isolation.
Figure 6C:
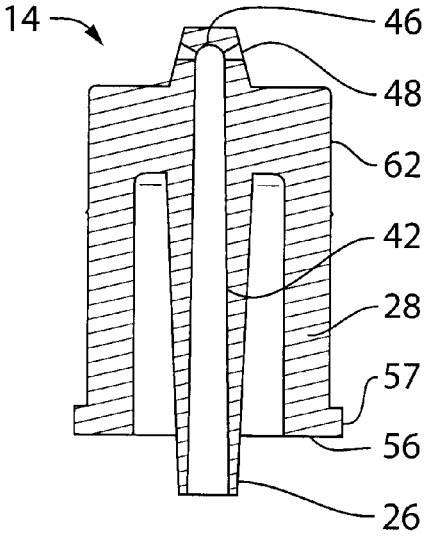
Figure 6D:
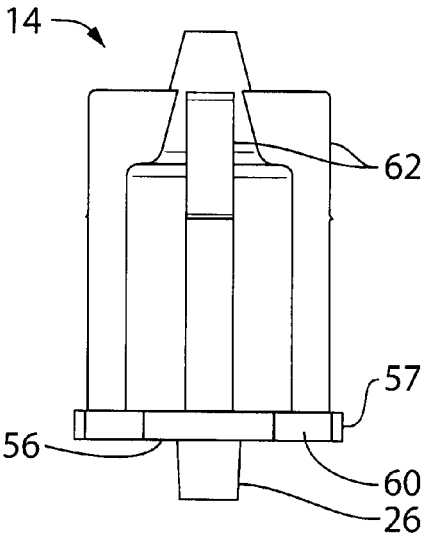
Figure 7A:
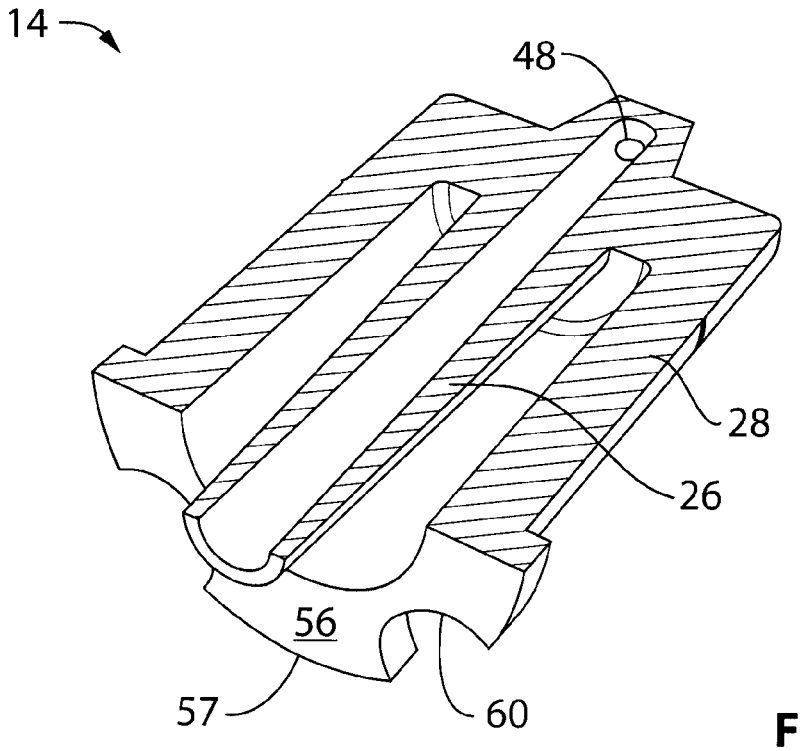
FIGS. 7A and 7B are cutaway bottom and top perspective views of the injector of the dispenser shown in FIG. 3 in isolation.
Figure 7B:
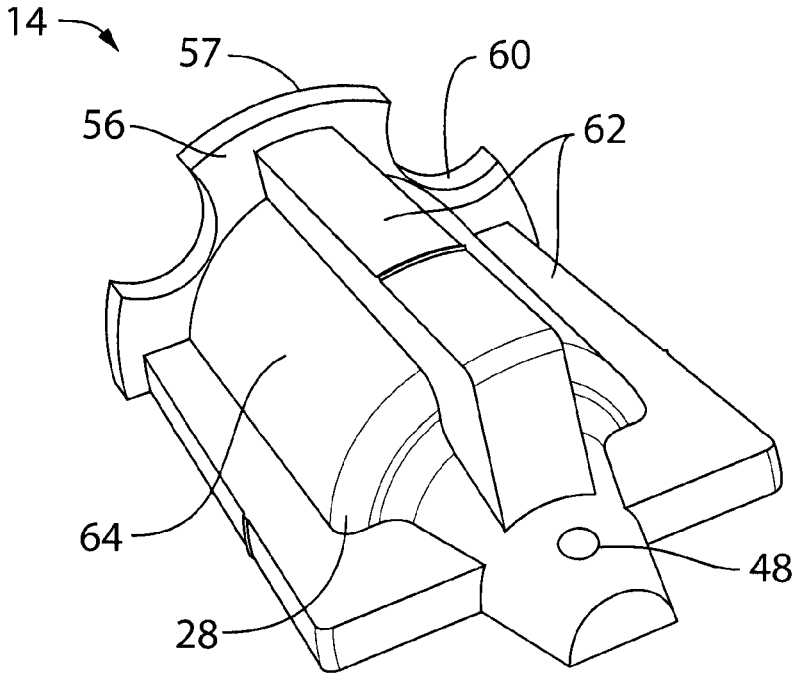

FIGS. 1 and 2 illustrate a known dispenser A. Dispenser A includes a side-by-side cartridge B, a mixing chamber C, a static mixer D, and a dispenser outlet E. As shown in FIG. 2 with the mixer housing for static mixer D removed, side-by-side cartridge B is fitted with a coaxial outlet F which includes a first outlet G for delivering a minor flow component to mixing chamber C and a second outlet H for delivering a major flow component to mixing chamber C. Known dispensers such as dispenser A have a number of problems including the following:

The major flow component (i.e., the adhesive component) and the minor flow component (i.e., the activator component) come in direct contact at coaxial outlet F. This can cause cross-contamination and blockage at coaxial outlet F if the component flow is interrupted for longer than the time it takes for the components to cure.

When static mixer D is removed, cured and partially blended components are left behind at coaxial outlet F. The cross-contaminated components must be cleaned out of coaxial outlet F before cartridge B can be used or flow will be prevented of restricted. For example, hardened particles of the cross-contaminated components can clog static mixer D, stopping flow. As a result, pressure may build up in cartridge B which may burst or piston seals (not shown) in cartridge B may fail causing piston leakage and damage to the dispenser.

Figure 9:
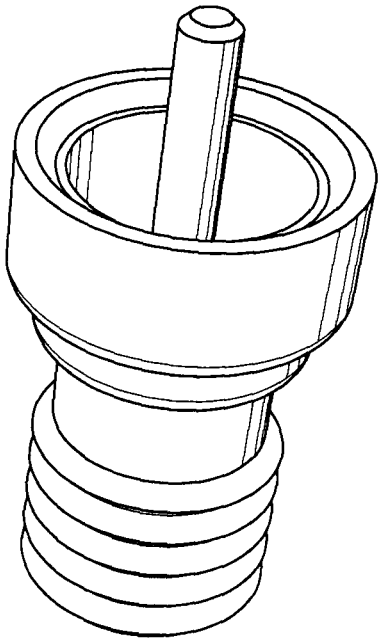
FIG. 9 is a perspective view of an extended-length storage plug.

Some flow components generate vapors that are able to transmit through the cartridge wall separating the flow components. Vapors crossing between the first outlet G and second outlet H can cause premature thickening and/or curing of the components within these outlets. This may be solved during the initial filling and storage by sealing with an extended-length storage plug (see FIG. 9) to keep the components separated at the proximal base of first outlet G and second outlet H. However, storage problems can still occur after the initial use once the storage plug has been removed.

During application, pressure is exerted on the cartridge pistons to extrude the respective flow components. The internal pressure causes the cartridge, typically constructed of a polymer material, to stretch. As the pressure is released at the end of the application, the cartridge shrinks back to its original shape, causing a small amount of the adhesive to flow out after the pressure on the pistons is released. When the two components are of unequal proportion as in a 10 to 1 ratio cartridge, the internal pressure and stretching is not equal. This unequal distortion causes the flow components to dispense slightly out of ratio at the beginning of an application and at the end of the application. For example, shrinking of the cartridge back to its original shape will cause an unequal flow of components out of first outlet G and second outlet H. The unequal flow at the end of the application may cause a small amount of the major flow component to backflow into first outlet G of the minor flow component. This backflow causes cross-contamination and the hardened adhesive can block first outlet G of the minor flow component.

The present invention addresses at least some of the above problems.

FIGS. 3 to 7 illustrate a dispenser 10 fitted with an injector 14 according to one embodiment of the invention. Dispenser 10 also includes a multi-chamber cartridge 12 and a static mixer 16.

Cartridge 12 includes a first storage chamber 18 and a second storage chambers 22. First storage chamber 18 has a first outlet 20 in coaxial arrangement with a second outlet 24 of second storage chamber 22. In the illustrated embodiment first storage chamber 18 stores a minor flow component (e.g. an activator) and second storage chamber 22 stores a major flow component (e.g. an unactivated adhesive). The major flow component is mixed with the minor flow component at some ratio greater than 1:1. In other embodiments the storage chambers may be the same size and the flow components may be mixed at a 1:1 ratio.

Injector 14 fits on to coaxial first and second outlets 20, 24 of cartridge 12. Injector 14 includes an inner sleeve 26 and an outer sleeve 28. Inner sleeve 26 fittingly engages inner wall 30 of first outlet 20. Inner sleeve 26 shields at least a portion of first outlet 20 from contact with flow components, keeping the interior of first outlet 20 clean for future applications. In some embodiments, the inner sleeve may extend up to or close to the proximal base of first outlet 20. Outer sleeve 28 has an inner wall 32 which fittingly engages outer wall 34 of first outlet 20. In other embodiments, the outer sleeve may be absent.

Inner sleeve 26 and outer sleeve 28 are concentric. Inner sleeve 26 and outer sleeve 28 connect at a distal shoulder 36 of injector 14. In other embodiments the cartridge outlets may be arranged one within another but not coaxially (i.e., the axes of the cartridge outlets may be offset); in such embodiments the inner and outer sleeves of the injector would be similarly offset to ensure proper engagement between the injector and cartridge outlets. A proximal portion of distal shoulder 36 matingly engages distal tip 40 of first outlet 20. In other embodiments the distal shoulder may not necessarily engage the distal tip of the first outlet.

In embodiments where the outer sleeve is absent, the distal portion of the inner sleeve may be provided with a stop having a proximal side for engagement with the distal tip of the first outlet to define the depth to which the injector inserts into the first outlet. Alternatively, friction fit between the outer wall of the inner sleeve and the interior of the first outlet may be sufficient to limit and define the extent to which the injector inserts into the first outlet.

In order to ensure a snug fit of the injector to the cartridge outlets, in some embodiments the injector may be provided with an inner sleeve and outer sleeve with a degree of resiliency and bias toward each other, i.e., the inner sleeve would be biased radially outwardly and the outer sleeve would be biased radially inwardly.

The displacement of spatial volume in first outlet 20 and second outlet 24 by injector 14 provides advantages. First, outer sleeve 28 displaces a volume of major flow component that would otherwise be present in the proximal, pre-mix region of second outlet 24 and mixer housing 66. The presence of outer sleeve 28 therefore reduces the wasted major flow component that would otherwise be left in second outlet 24 and mixer housing 66 after a final application.

Second, inner sleeve 26 displaces a volume of air that would otherwise be present in first outlet 20 during initial use or use after an extended-length storage plug is used during storage. Extended-length storage plugs extend the seal to the proximal base of first outlet 20 to increase the distance the minor flow component would have to migrate to evaporate and to separate the minor and major flow components to minimize the possibility of cross-contamination. During initial use or when an extended-length storage plug is removed at any other time, there is an air void in first outlet 20 that must be filled with the minor flow component as it flows to mixing chamber 44. Similarly there is an air void in second outlet 24 that must be filled with the major flow component as it flows to mixing chamber 44. The major flow component flows in greater volume and it typically reaches mixing chamber 44 in advance of the minor flow component; therefore the first mixtures dispensed from static mixers in known dispensers do not have adequate minor flow component to activate the adhesive. This initial mixture is therefore not usable. According to the invention, the presence of inner sleeve 26 in first outlet 20 displaces the air void that would otherwise need to be taken up by the minor flow component, and this in turn allows the minor and major flow components to reach mixing chamber 44 simultaneously to provide a proper initial mixture of the components. The wall thickness of inner sleeve 26 and/or outer sleeve 28 may be adjusted relative to the desired ratio of the two adhesive components to ensure simultaneous flow of the components into mixing chamber 44.

The third advantage provided is that inner sleeve 26 displaces a volume of minor flow component that would otherwise be left in first outlet 20 after an application. In the absence of the inner sleeve such as in known dispensers, that volume of minor flow component would, upon insertion of an extended-length storage plug, overflow into the mixing chamber and the second outlet. Cross-contamination with the major flow component in the second outlet would cause hardening of the components in the second outlet, rendering the cartridge useless. The presence of inner sleeve 26 avoids this problem by displacing the volume of minor flow component that would otherwise overflow.

The interior of inner sleeve 26 defines a flow passage 42 for the minor flow component to flow from first storage chamber 18 and first outlet 20 to mixing chamber 44. Flow passage 42 tapers from a wider diameter to a narrower diameter toward the distal direction. In other embodiments, the flow passage may not taper. The distal end 46 of flow passage 42 includes two opposing injector outlet holes 48 radiating outward to mixing chamber 44. Distal end 46 may be hemispherical to facilitate flow of the minor flow component out of injector outlet holes 48.

The injector outlet holes in the illustrated embodiment are circular but in other embodiments may be any other suitable shape. Also in other embodiments, one, or more than two, injector outlet holes may be provided. In yet other embodiments, the injector outlet holes may be absent and the flow passage may directly connect to the mixing chamber. Mixing of the two components is improved by splitting the flow of the minor flow component into multiple streams and directing the streams toward the outer regions of mixing chamber 44 where mixing action (i.e., shear force) during an application is the greatest. Improved mixing allows for reduction of one or more of the mixing elements 50 in static mixer 16, which in turn results in reduced back pressure or pressure drop to minimize backflow of the components.

Injector outlet holes 48 are sized as small as possible to allow flow of low viscosity minor flow component into mixing chamber 44 but at the same time limit backflow of high viscosity major flow component, or mixed components, back into flow passage 42. The diameter of injector outlet holes 48 depends on the size of the cartridge. For standard handheld cartridge sizes of 50 mL to 1000 mL, the range of diameters may be about 0.005" to 0.100", and preferably from about 0.010" to 0.035".

Mixer elements 50 and dispenser outlet 17 are designed to maintain a low back pressure so that residual pressure in dispenser 10 (between applications) is released out of dispenser outlet 17 and internal pressure is reduced, minimizing the force causing backflow into flow passage 42. For example, in some embodiments dispenser outlet 17 may be provided as large as practical (while accommodating the required flow fate and the viscosity of the mixed components), and injector outlet holes 48 may be provided as small as practical (while accommodating the required flow rate and viscosity of the minor flow component).

Injector 14 also includes a flange 56 at the proximal end of outer sleeve 28. In other embodiments, the flange may be absent. The outer edge 57 of flange 56 may abut against the inner wall 58 of second outlet 24. Flange 56 has one or more cutouts 60 to allow the major flow component to flow therethrough. In other embodiments, the flange may have holes or be otherwise perforated. Flange 56 aids in cleaning out second outlet 24 when injector 14 is removed from cartridge 12. In particular, as injector 14 is twisted and removed, flange 56 pulls both soft and hardened components out of second outlet 24.

Injector 14 further includes longitudinal ridges 62 radiating outward from outer sleeve 28 and extending from flange 56 (or the proximal end of injector 14) in a distal direction. In other embodiments the ridges may be absent. The spaces between ridges 62 and flange cutouts 60, bordered by ridges 62, the outer wall 64 of outer sleeve 28, inner wall 58 of second outlet 24, and the inner wall 68 of mixer housing 66, define a flow passage for the major flow component.

In some embodiments, ridges 62, and outer wall 64 of outer sleeve 28 may be provided with a textured surface that provides better bonding with hardened components. The textured surface enhances removal of hardened components from second outlet 24 as injector 14 and static mixer 16 are removed.

The invention accordingly guides the flow of components and reduces, if not eliminates, cross-contamination between the components and their vapors. For example, in order for any vapor cross-contamination to occur where injector 14 is fitted, vapors would have to either flow through small injector outlet holes 48 or permeate through three layers of solid material, namely outer sleeve 28, first outlet 20, and inner sleeve 26. In embodiments of the invention wherein the outer sleeve is absent, vapors would still have to permeate through two layers of solid material, namely the first outlet and the inner sleeve, to cross-contaminate. If any hardening of the components occurs due to any such cross-contamination, the hardened material would be removed in as described above when injector 14 and static mixer 16 are removed, thereby preventing blockage within cartridge 12.

Figure 8:
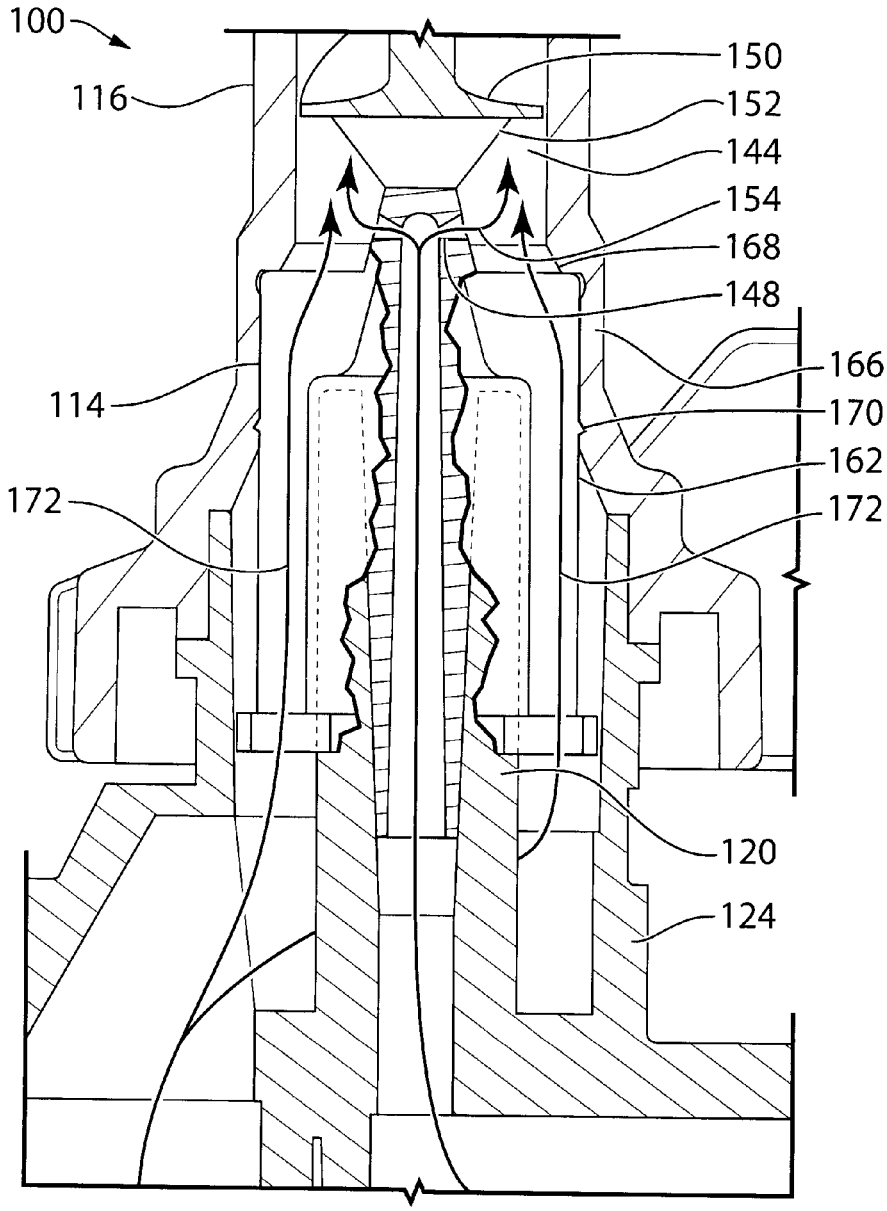
FIG. 8 is an enlarged cutaway side view of a part of an injector and dispenser according to one embodiment of the invention.

FIG. 8 shows an alternative embodiment in injector 114 and dispenser 100. Features including first outlet 120, second outlet 124, mixing chamber 144, injector outlet holes 148, ridges 162, mixer housing 166 function similarly to analogous features in injector 14 and dispenser 10. Arrows 154 and 172 show the flowpath of the minor flow component and major flow component respectively, and is for the most part identical to the flowpaths for the components in injector 14 and dispenser 10. The only difference is that dispenser 100 includes an inverted frustoconical element 152 positioned distal of injector outlet holes 148 and proximal of the first mixing element 150 which enhances the direction of the minor flow component toward the outer regions of mixing chamber 144. Frustoconical element 152 may be molded integrally with the injector, molded integrally with the static mixer, or provided as a separate piece from the injector and the static mixer.

Also shown in the embodiment in FIG. 8 are tongue-and-groove type locking elements 170 on ridges 162. Locking element 170 may be a sealing ridge for locking engagement with a corresponding locking element such as a retaining ring disposed on inner wall 168 of mixer housing 166. The locking mechanism allows injector 114 to be removed along with static mixer 116. Any other suitable locking elements may be used in other embodiments.

As will be apparent to those skilled in the art in the light of the foregoing disclosure, many alterations and modifications are possible in the practice of this invention without departing from the spirit or scope thereof. For example:

the injector may be provided as a separate device from the static mixer, or provided as an integral part of a mixer assembly that includes the static mixer.

some or all parts of the injector may be provided as an integral part of the cartridge outlets.

The invention claimed is:

1. An injector for a dispenser for multiple flowable components, the dispenser having a multi-chamber cartridge with a first outlet for a first flowable component arranged within a second outlet for a second flowable component, the injector comprising:

an inner sleeve for fitting engagement with an inner wall of the first outlet of the dispenser, wherein an interior of the inner sleeve defines a first passage for the first flowable component;

wherein a distal end of the first passage comprises at least one injector outlet hole; and wherein the injector outlet hole is sized to restrict backflow of the second flowable component into the first passage, wherein the injector outlet hole has a diameter in the range of 0.005" to 0.100".

2. An injector according to claim 1 wherein the injector outlet hole has a diameter in the range of 0.010" to 0.035".

3. An injector according to claim 1 wherein the injector outlet hole widens in the direction away from the first passage.

4. An injector according to claim 1 wherein the injector outlet hole is oriented radially outward.

5. An injector according to claim 1 wherein a distance from the injector outlet hole to a proximal end of the inner sleeve is at least double a diameter of the first outlet.

6. An injector according to claim 1 wherein the inner sleeve is sized to displace a sufficient volume of the first flowable component within the first outlet to prevent overflow of the first flowable component from the first outlet when an extended-length storage plug is inserted into the first outlet.

7. An injector according to claim 1 wherein the distal end of the first passage comprises a plurality of the injector outlet holes.

8. An injector according to claim 1 wherein a wall thickness of the inner sleeve is sized to provide simultaneous flow of the first flowable component and the second flowable component into a mixing chamber of the dispenser at a predetermined mixing ratio.

9. An injector according to claim 1 further comprising an outer sleeve for fitting engagement with an outer wall of the first outlet of the dispenser, wherein the outer sleeve and the inner sleeve are coupled.

10. An injector according to claim 9 wherein an exterior of the outer sleeve partially defines a second passage for the second flowable component.

11. An injector according to claim 10 wherein wall thicknesses of the inner sleeve and/or the outer sleeve are sized to provide simultaneous flow of the first flowable component and the second flowable component through the first passage and the second passage respectively into a mixing chamber of the dispenser at a predetermined mixing ratio.

12. An injector according to claim 1 wherein the distal end of the first passage is hemispherical.

13. An injector according to claim 1 comprising an inverted frustoconical element disposed distal of the injector outlet hole and proximal of a static mixer of the dispenser.

14. An injector according to claim 13 wherein the frustoconical element is molded integrally with the injector, molded integrally with the static mixer, or provided as a separate piece from the injector and the static mixer.

15. An injector according to claim 9 wherein the outer sleeve comprises a plurality of radially arranged ridges, wherein spaces between the ridges partially define the second passage.

16. An injector according to claim 15 wherein an outer wall of the ridges comprise a locking element for interlocking with a locking element on an inner wall of a mixer housing of the dispenser.

17. An injector according to claim 9 wherein a proximal end of the outer sleeve comprises an outwardly radiating flange for abutment against an inner wall of the second outlet, wherein the flange comprises a plurality of cutouts.

18. A mixing assembly comprising:

a static mixer; and an injector according to claim 1.

19. A dispenser comprising:

a multi-chamber cartridge comprising a plurality of outlets;

a static mixer; and an injector according to claim 1.

20. A dispenser according to claim 19 wherein the static mixer and the injector are spaced apart to define a mixing chamber therebetween.

* * * * *